US005263433A

United States Patent [19]

Meyer

[11] Patent Number: 5,263,433

[45] Date of Patent: Nov. 23, 1993

[54] HYBRID HYDROFOIL STRUT LEADING EDGE EXTENSION

[75] Inventor: John R. Meyer, Derwood, Md.

[73] Assignee: The United States of America as represented by the Secretary of the Navy, Washington, D.C.

[21] Appl. No.: 930,936

[22] Filed: Aug. 17, 1992

[51] Int. Cl.[5] ..... B63B 1/06

[52] U.S. Cl. ..... 114/282; 114/280; 114/284; 114/61

[58] Field of Search ..... 114/56, 61, 271, 274, 114/280, 282, 275, 278, 279, 284, 339; 244/123

[56] References Cited

U.S. PATENT DOCUMENTS

| | | | |
|---|---|---|---|
| 3,184,187 | 5/1965 | Isaac | 114/282 |
| 3,338,202 | 8/1969 | Roper | 514/280 |
| 3,540,400 | 11/1970 | Boston | 114/56 |
| 4,080,922 | 3/1978 | Brubaker | 114/282 |
| 4,452,166 | 6/1984 | Daniel | 114/282 |
| 4,763,596 | 8/1988 | Yoshida | 114/61 |

FOREIGN PATENT DOCUMENTS

| | | | |
|---|---|---|---|
| 2337995 | 5/1974 | Fed. Rep. of Germany | 114/280 |

OTHER PUBLICATIONS

Naoki Yamanaka "A Submerged Hull and Foil Hybrid Super-High Speed Liner" First International Conference on Fast Sea Transportation Jun. 17-21, 1991 pp. 163-178.

John R. Meyer "Hybrid Hydrofoil Technology Applications" Jun. 24-27, 1992.

*Primary Examiner*—Robert J. Oberleitner
*Assistant Examiner*—Clifford T. Bartz
*Attorney, Agent, or Firm*—Charles D. Miller

[57] ABSTRACT

A strut leading edge extension for a marine vehicle has an upper hull, a strut, a lower hull, and a foil. The strut leading edge extension includes a device for defining an extended strut leading edge, the device being adjustable to a plurality of positions including a fully retracted position and a fully extended position. The defining device is disposed at a front portion of the strut. An actuator moves the defining means to a plurality of positions; wherein a directional dynamic stability of the marine vehicle may be controlled by the position of the defining device.

15 Claims, 5 Drawing Sheets

HYBRID HYDROFOIL STRUT LEADING EDGE EXTENSION

The invention described herein may be manufactured and used by or for the Government of the United States of America for governmental purposes without the payment of any royalties thereon or therefor.

BACKGROUND OF THE INVENTION

The present invention relates to a hybrid hydrofoil marine vehicle, and in particular to a marine vehicle having a hybrid hydrofoil with an extendable strut leading edge.

Hybrid hydrofoil marine vehicles designs are known in the prior art. Referring to FIG. 1, a marine vehicle 10 constructed according to the hybrid hydrofoil concept includes an upper hull 12 of the conventional monohull form with the addition of a long, slender, single strut 18 and a lower body or lower hull 14 added to its keel. The lower body buoyant lift is augmented by the dynamic lift from the fully submerged foil system 16. Foil dynamic lift comes into play at speeds of about 12–15 knots and above, at which time the upper hull is lifted from the water surface leaving only the small water plane of the single strut at the interface between air and water. The foil automatic control system maintains predetermined flying height and provides a stable platform in waves. The foil surfaces are sufficiently powerful to counter roll, pitch, and heave motions that would be imparted to a conventional monohull in high sea states. Propulsion of the vehicle can be provided by one or more prime movers located in the upper hull driving through a Z-drive to a propeller on the stern of the lower hull, or by prime movers in the lower hull driving straight through to one or more propellers.

Details of the hybrid hydrofoil concept and its applications can be found in "Hybrid Hydrofoil Technology Applications" by John R. Meyer, High Performance Marine Vehicles Conference and Exhibit, Washington, D.C., June 1992, incorporated herein by reference.

One of the problems in designing the hybrid hydrofoil is to define the strut 18 dimensions and location (i.e. set-back A from the lower hull nose 20) in such a way that the marine vehicle has acceptable directional (lateral) dynamic stability in all foilborne modes. These modes include the nominal shallow draft condition (where a relatively small part of the strut is immersed) and a deeper draft condition (where the water line is close to the bottom of the upper hull).

Closely associated with the directional dynamic stability characteristic is the relative ability to execute coordinated turns. If the marine vehicle is too stable, it will be difficult to turn; if it is close to being dynamically unstable, it can achieve relatively high turn rates.

Recent analyses of the directional dynamic stability and turning characteristics of a hybrid hydrofoil marine vehicle, as shown in FIG. 1, indicate that the directional dynamic stability is sensitive to strut leading edge set-back (distance A from the nose 20 of the lower hull) and overall strut length. Apparently, small decreases (one to two feet) in strut leading edge set-back can change the hybrid hydrofoil's directional dynamic stability characteristic from positive to negative.

SUMMARY OF THE INVENTION

It is an object of the present invention to provide an adjustable strut leading edge extension for a hybrid hydrofoil marine vehicle.

It is another object of the invention to provide an automatic control system for a strut leading edge extension for a hybrid hydrofoil marine vehicle.

It is a further object of the invention to provide a hybrid hydrofoil marine vehicle having a variable directional dynamic stability.

It is a still further object of the invention to provide a hybrid hydrofoil marine vehicle that is easily steerable.

These and other objects and advantages of the present invention are achieved by a strut leading edge extension for a marine vehicle. The marine vehicle has an upper hull, a strut, and a lower hull. The strut leading edge extension includes a device for defining an extendable strut leading edge. The defining device is adjustable to a plurality of positions including a fully retracted position and a fully extended position. The defining device is located at a front portion of the strut. The leading edge extension includes an actuator to move the defining device to the plurality of positions wherein the directional dynamic stability of the marine vehicle varies as the defining device moves from the fully retracted position to the fully extended position.

The invention also includes a means for automatically controlling the strut leading edge extension responsive to a helm command, wherein the degree of extension is generally directly proportional to the magnitude of the helm command.

BRIEF DESCRIPTION OF THE DRAWINGS

The invention is described in relation to the detailed description of preferred embodiments of the invention wherein.

DETAILED DESCRIPTION OF THE PREFERRED EMBODIMENTS

Figure 1:
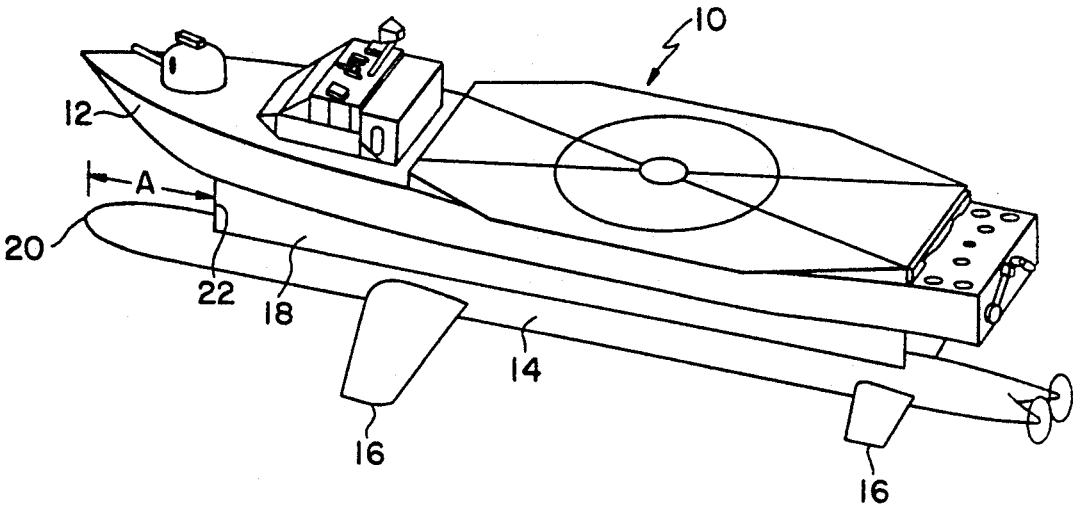
FIG.1 PRIOR ART
FIG. 1 is a perspective view of a hybrid hydrofoil marine vehicle of the prior art.

Referring to FIG. 1, a marine vehicle 10 of the hybrid hydrofoil design includes an upper hull 12, a strut 18, and a lower hull 14 having hydrofoils 16. The upper hull 12 is of a conventional monohull form with the addition of a long, slender, single strut 18 and a lower body or a lower hull 14 added below the strut. The lower hull 14 buoyant lift is augmented by the dynamic lift of the fully submerged foils 16.

The inventor has discovered that the directional (lateral) dynamic stability and turning characteristics of the hybrid hydrofoil marine vehicle are sensitive to strut leading edge set-back and overall strut length. Strut leading edge set-back is the distance A from the nose 20 of the lower hull to the leading edge 22 of the strut 18. Small decreases in strut leading edge set-back can change the marine vehicle's directional dynamic stability characteristic from positive to negative.

The present invention is directed to an extendable strut leading edge wherein the strut leading edge set-back can be varied while the marine vehicle is operating.

Referring now to FIGS. 2–7, the strut leading edge extension includes means 24, 24' for defining an extended strut leading edge. The defining means is adjustable to a plurality of positions from a fully retracted position (shown in solid lines in FIGS. 2–7) to a fully extended position (shown in dotted lines in FIGS. 2–7). The defining means 24, 24' is located at a forward end 30 of the strut 18. The defining means 24 is shown having a triangular shape in FIGS. 2, 4, and 5 and the defining means 24' is shown as having a rectangular shape in FIGS. 3, 6, and 7; however, other shapes are also possible and contemplated by the invention. The defining means 24, 24' preferably has a thinner cross-section than the strut 18, has a rigid construction, and is similar to a flap.

Figure 2:
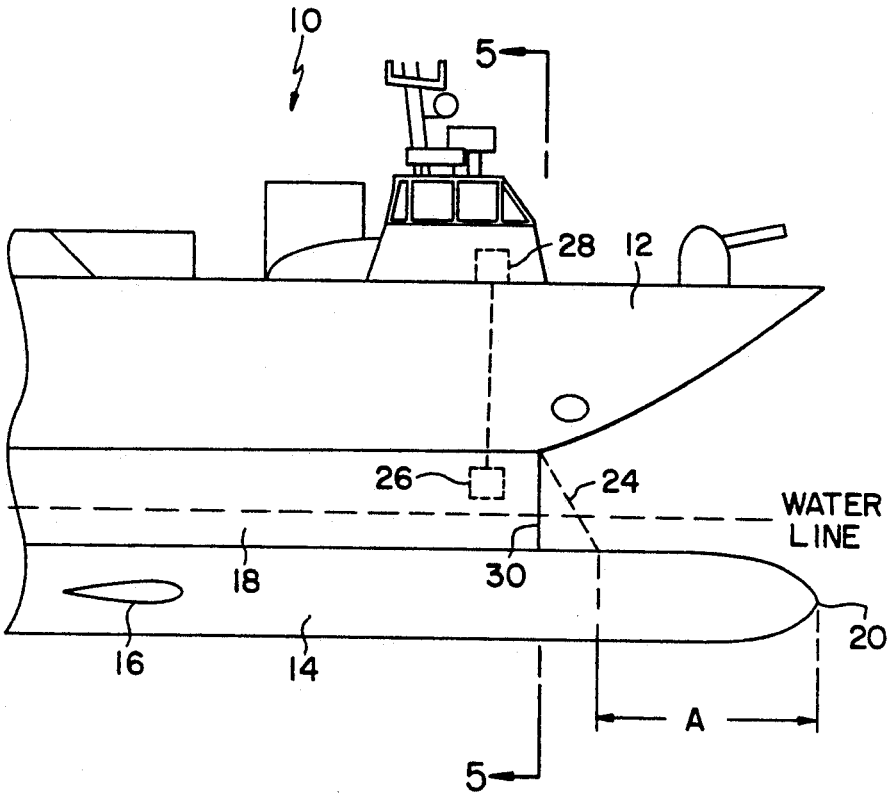
FIG. 2 is a side view of a hybrid hydrofoil marine vehicle showing a first embodiment of the strut leading edge extension of the present invention.
Figure 3:
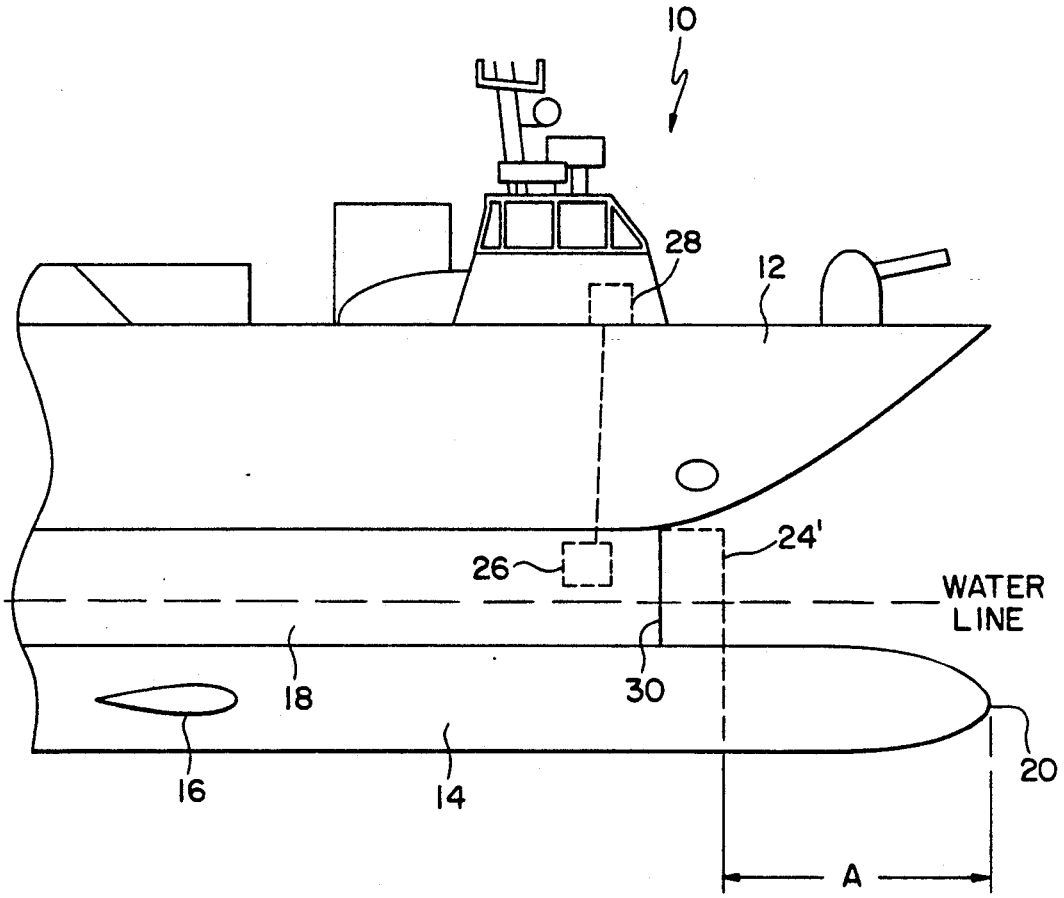
FIG. 3 is similar to FIG. 2, but shows a second embodiment of the strut leading edge extension.

The defining means 24, 24' is moved to its various positions by an actuator 26 shown in dotted lines as a "black box" in FIGS. 2 and 3. The actuator 26 may be a hydraulic, electrical or any other suitable actuating device connected to mechanically move the defining means 24, 24' between its fully extended and retracted positions so that the defining means 24, 24' may assume not only the fully extended and retracted positions but, preferably, any position therebetween.

Figure 5:
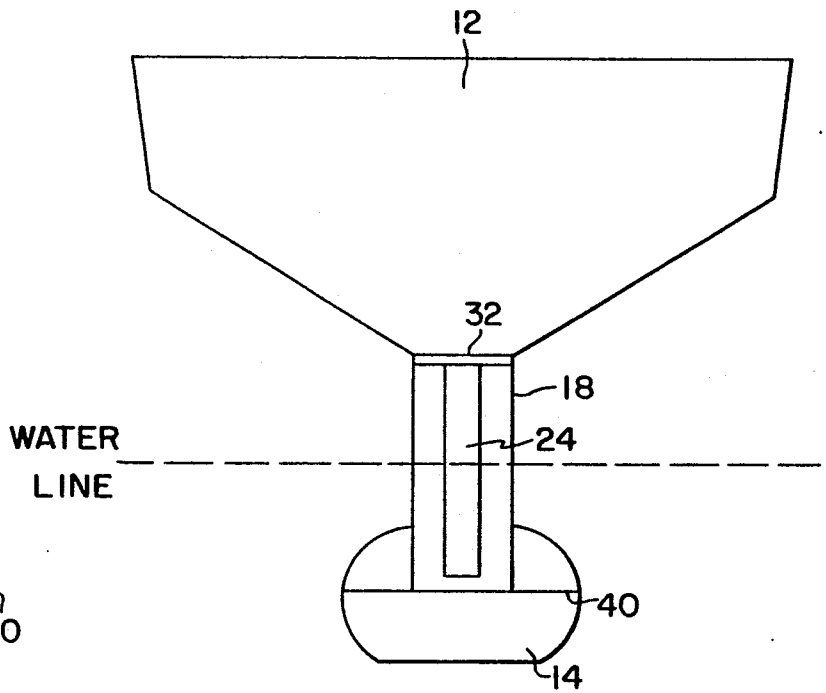
FIG. 5 is an enlarged fragmentary cutaway view taken along the line 5—5 of FIG. 2, but omitting the structure above the upper deck for clarity.
Figure 4:
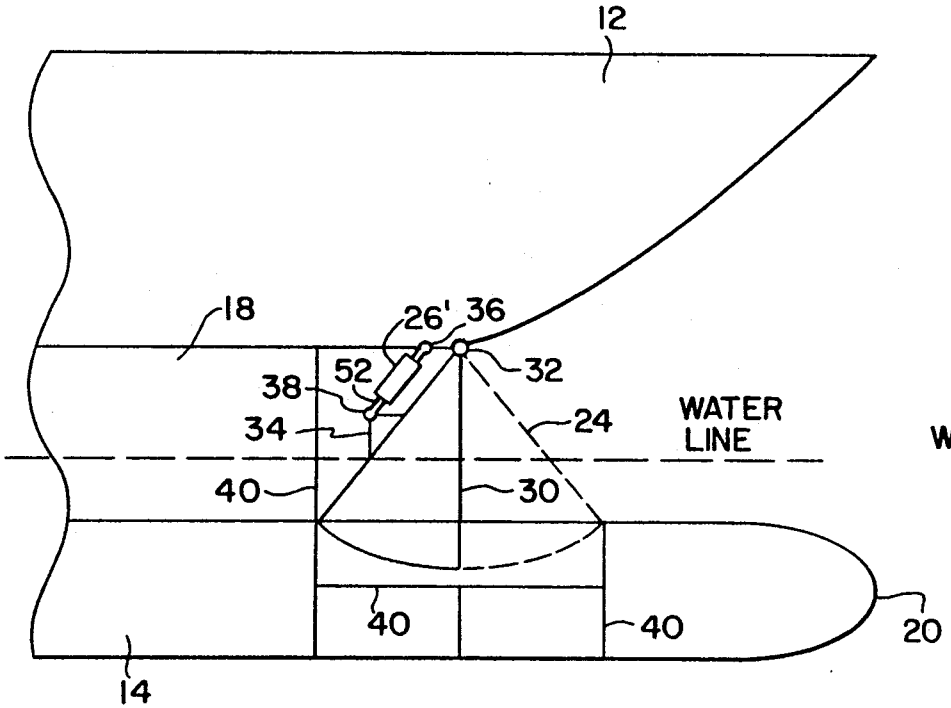
FIG. 4 is an enlarged fragmentary cutaway view along the centerline of the first embodiment of FIG. 2.

In FIG. 4, the actuator 26' is shown more particularly as an actuator 26' which may take the form of a hydraulic or electric actuator for rotating the defining means 24 from a fully retracted position (shown in solid lines) to a fully extended position (shown in dotted lines). The actuator 26' is attached to the defining means 24 by a bracket 34 via a pin connection 38 and rod 52 and to the hull 12 by a pin connection 36 to both support and rotate the defining means 24. The defining means 24 is further rotatably supported by a pin connection 32 at the bottom of the upper hull 12. The defining means 24 is housed and rotates through openings in the strut 18 and lower hull 14 as shown in FIG. 5.

Watertight bulkheads 40 are provided in the lower hull 12 and strut 18 to isolate the openings in the lower hull 12 and strut 18 from the remainder of the strut and lower hull. To rotate the defining means 24 from its fully retracted position to its fully extended position; the actuator 26' is activated to extend the rod 52 connected to the pin 38 and bracket 34. The extending rod 52 forces the defining means 24 to rotate in a counterclockwise direction as seen in FIG. 4 about the pin 32 and the actuator 26' to rotate counter-clockwise about pin 36. The actuator 26' is free to change its position relative to bracket 34 via rotation about pin 38. The position of the defining means 24 is determined by the amount of extension of the actuator rod 52 connected to the pin 38.

Figure 6:
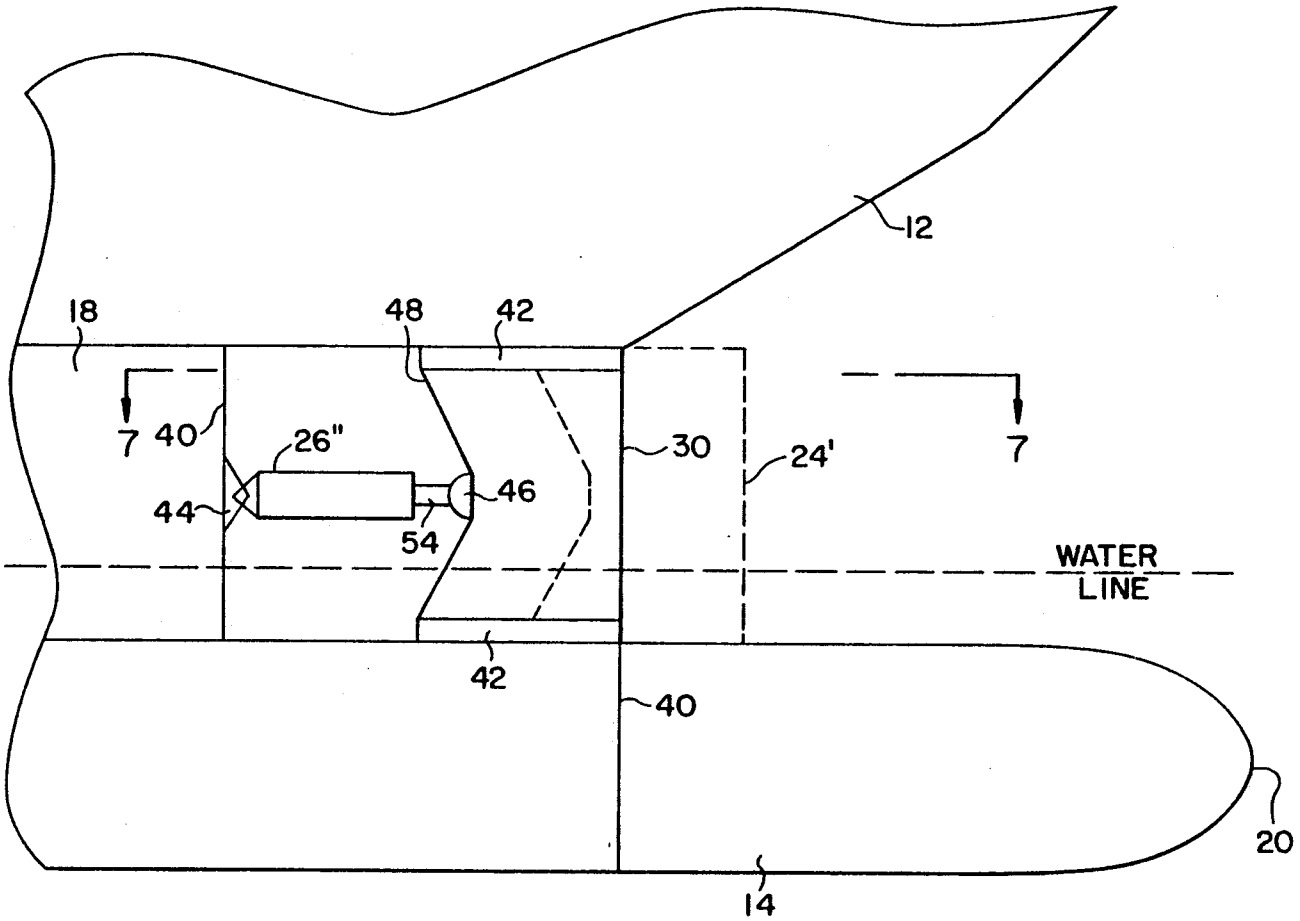
FIG. 6 is an enlarged fragmentary cutaway view along the centerline of the second embodiment of FIG. 3.
Figure 7:
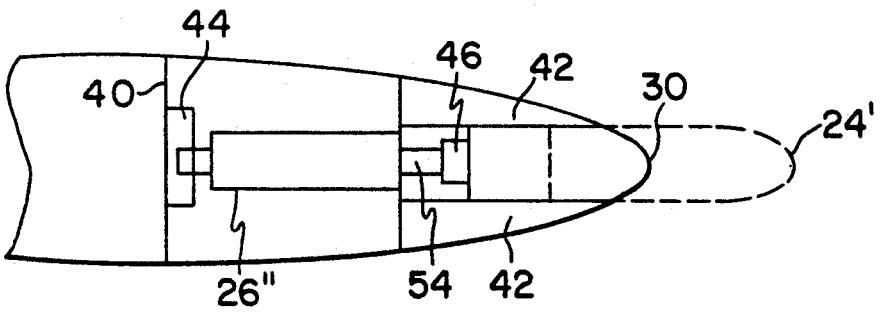
FIG. 7 is an enlarged fragmentary cutaway view along the line 7—7 of FIG. 6, but omitting the lower hull for clarity.

In FIGS. 6 and 7, the actuator 26 of FIG. 3 is more particularly shown as an actuator 26'' which may be a hydraulic or electric actuator for pushing and pulling the defining means 24' between its fully retracted position (solid lines), fully extended position (broken lines), and intermediate positions. The actuator 26'' is attached at one end via a bracket 44 to a watertight bulkhead 40 in the interior of the strut 18. The other end of the actuator 26'' is attached to the defining means 24' at a front end 46 of the actuator 26'' via a rod 54. The rear surface 48 of the defining means 24' is conveniently formed in a wide V-shape to reduce the amount of space used in the strut 18. It is important to conserve space in the strut 18 for storing fuel, fresh water, etc. The defining means 24' is guided by two sets of guide rails 42 provided in the strut 18 to form a channel for the defining means 24'. Defining means 24' moves in and out of the strut 18 through an opening formed in the strut. Watertight bulkheads 40 isolate the open area of the strut 18 from the rest of the strut. The position of the defining means 24' is determined by the amount of extension of the actuator rod 54.

When the defining means 24, 24' is in the fully retracted position, it has no effect on the directional dynamic stability of the marine vehicle. As the defining means 24, 24' is extended forward towards the nose 20 of the lower hull, the directional dynamic stability of the marine vehicle decreases. The directional dynamic stability reaches a minimum when the defining means 24,24' is in its fully extended position.

As the defining means 24, 24' is extended forward, the strut leading edge set-back distance A decreases. Therefore, the vehicle's directional dynamic stability decreases, and the turn rate capability increases. Therefore, when making a turn, the vehicle is more easily steerable if the strut leading edge is extended forward.

Automatic control systems for hydrofoil marine vehicles are known in the art. However, in the present invention, the automatic control system of the hybrid hydrofoil marine vehicle includes a means 28 for automatically controlling the strut leading edge extension, as shown schematically in FIGS. 2 and 3. The automatic control means 28 is responsive to a helm command so that the larger the helm command, the greater the degree of extension of the strut leading edge extension. Therefore, when the vehicle operator introduces a helm command, the strut leading edge extension is activated in a manner that is proportional to the desired turn rate. Large helm commands will extend the strut extension to its maximum, whereas small changes in course, below a given threshold, do not even actuate the device. The automatic control means 28 is connected to the actuating means 26, 26', 26'', to control the amount of extension.

Although the present invention has been described in reference to certain preferred embodiments, many varieties of configurations and equivalents of the present invention are possible without departing from the spirit and scope of the invention.

Figure 8:
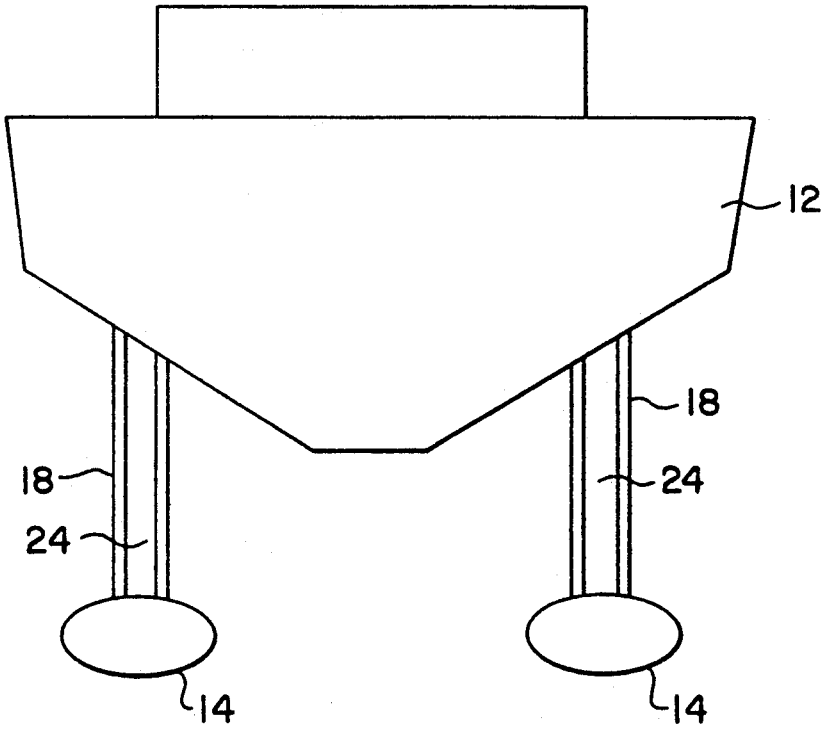
FIG. 8 is a front view of a third embodiment.

For example, although a marine vehicle having a single strut 18 has been described, the invention also encompasses embodiments having more than one strut 18, or more than one lower hull 14. In such a case, a strut leading edge extension may be provided for each strut, as shown in FIG. 8.

What is claimed is:

1. A strut leading edge extension for a marine vehicle, the marine vehicle having an upper hull, a strut, a lower hull, and a foil; the strut leading edge extension comprising:

means for defining an extendable strut leading edge, said defining means being adjustable to a plurality of positions including a fully retracted position and a fully extended position, said defining means being disposed at a front portion of said strut;

means for actuating said defining means to move said defining means to said plurality of positions;

wherein a directional dynamic stability of said marine vehicle may be controlled by the position of said defining means.

2. The strut leading edge extension of claim 1, wherein said actuating means comprises a hydraulic actuator.

3. The strut leading edge extension of claim 1, wherein said actuating means comprises an electrical actuator.

4. The strut leading edge extension of claim 1, further comprising means for automatically controlling said actuating means, said automatic control means controlling said actuating means in response to a helm command, wherein a degree of extension of said defining means is generally directly proportional to a size of said helm command.

5. The strut leading edge extension of claim 1, wherein said defining means is housed in said strut.

6. The strut leading edge extension of claim 1, wherein the defining means has a cross-section with a width that is less than a width of a cross-section of the strut.

7. The strut leading edge extension of claim 1, wherein the defining means comprises a triangular flap.

8. The strut leading edge extension of claim 1, wherein the defining means comprises a rectangular flap.

9. A marine vehicle, comprising:

an upper hull;

a strut having upper and lower sides, said strut being attached to said upper hull at said upper side;

a lower hull, said lower hull being attached to said strut at said lower side;

a foil; and an extendable strut leading edge.

10. The marine vehicle of claim 9, wherein the extendable strut leading edge is adjustable to a plurality of positions including a fully retracted position and a fully extended position.

11. The marine vehicle of claim 10, further comprising means for actuating said extendable strut leading edge to move said extendable strut leading edge to said plurality of positions.

12. The marine vehicle of claim 10, wherein a directional dynamic stability of said marine vehicle may be controlled by the position of said extendable strut leading edge.

13. The marine vehicle of claim 9, further comprising means for automatically controlling said extendable strut leading edge, said automatic control means being responsive to a helm command, wherein a degree of extension of said extendable strut leading edge is generally directly proportional to a characteristic of said helm command.

14. The marine vehicle of claim 12, further comprising a plurality of struts and a corresponding plurality of extendable strut leading edges.

15. A marine vehicle compromising a first hull, a second hull, said first hull and said second hull being vertically spaced apart, a strut having a top side and a bottom side and a leading edge and a trailing edge, the distance between said leading edge and said trailing edge being greater than the distance between said top side and said bottom side, the top side of said strut being connected to said first hull and the bottom side of said strut being connected to said second hull, means for extending the leading edge of said strut when said vehicle is at rest and when in forward motion, whereby the said marine vehicle has improved turning capability when said leading edge is extended but has better course keeping capability when said leading edge is retracted.

* * * * *